United States Patent [19]

Shipes

[11] 4,008,007

[45] Feb. 15, 1977

[54] AXIAL FLOW FAN ASSEMBLY

[75] Inventor: Kelly V. Shipes, Houston, Tex.

[73] Assignee: Hudson Products Corporation, Houston, Tex.

[22] Filed: May 23, 1975

[21] Appl. No.: 580,338

[52] U.S. Cl. ..... 417/363; 165/DIG. 1; 415/119; 416/500

[51] Int. Cl.[2] ..... F04B 17/00

[58] Field of Search ..... 417/362, 363; 415/119; 416/190, 500; 165/DIG. 1, 225; 188/1 B

[56] References Cited

UNITED STATES PATENTS

| | | | |
|---|---|---|---|
| 1,830,535 | 11/1931 | Fitch | 188/1 B |
| 2,028,930 | 1/1936 | Taylor | 188/1 B |
| 2,191,418 | 2/1940 | Allen | 248/15 |
| 2,558,541 | 6/1951 | Cotten | 248/15 |
| 2,558,541 | 6/1951 | Cotten | 416/500 |
| 2,586,043 | 2/1952 | Hodgson et al. | 188/1 B |
| 2,715,951 | 8/1955 | Lieber | 188/1 B |
| 2,729,518 | 1/1956 | O'Connor | 188/1 B |
| 2,735,611 | 2/1956 | McLean | 248/15 |
| 2,796,149 | 6/1957 | Wallin | 188/1 B |
| 3,091,307 | 5/1963 | Tiedemann et al. | 188/1 B |
| 3,172,630 | 3/1965 | Goodman | 188/1 B |
| 3,333,707 | 8/1967 | Bange et al. | 248/15 |
| 3,337,165 | 8/1967 | Kondo | 248/15 |
| 3,372,758 | 3/1968 | Jenney | 416/19 |
| 3,768,546 | 10/1973 | Shipes | 165/DIG. 1 |
| 3,898,019 | 8/1975 | Reznick | 417/363 |

FOREIGN PATENTS OR APPLICATIONS

| | | | |
|---|---|---|---|
| 1,064,742 | 12/1953 | France | 188/1 B |
| 968,430 | 9/1964 | United Kingdom | 165/122 |

*Primary Examiner*—C. J. Husar
*Attorney, Agent, or Firm*—W. F. Hyer; Marvin B. Eickenroht

[57] ABSTRACT

There is disclosed an axial flow fan assembly having a vibration dampener carried by the fan supporting means which extends across the fan ring.

16 Claims, 3 Drawing Figures

AXIAL FLOW FAN ASSEMBLY

This invention relates generally to large diameter axial flow fan assemblies for use in air coolers or other environments requiring a large volume of air flow. More particularly, it relates to improvements in such fans of the type in which the shaft of the fan is supported by supporting means extending across and supported at opposite ends by a fan ring to mount the fan blades for rotating within the ring.

Turbulence in the air flow induced by rotation of the fan blades past the supporting means causes the fan and its shaft to vibrate, which in turn creates vibrations in the supporting means. This vibration is a cause of considerable stress and mechanical failures in large diameter fan assemblies, where the supporting means is quite long and thus flexible between its ends. Vibration is even a greater problem when, as is often the case, the fan motor is also carried by the supporting means to one side of the fan shaft.

The frequency of the vibration is a function of the number and speed of rotation of the blades — i.e., the number of times each blade passes the supporting means per unit of time. For example, when the fan has an even number of blades, this frequency is equal to the number of blades multiplied by the speed of rotation of the fan.

Large diameter fan assemblies also cause considerable noise, which is an ever increasing environmental problem. In an effort to reduce noise, it has been proposed to reduce the rotational speed of the fan, which results in a lower frequency of vibration, and thus, for a given vibrating driving force, in greater amplitudes of vibration.

By far the greatest vibration in the supporting means is in a vertical direction. Although such vibrations could be lessened by stiffening the supporting means, which normally comprise laterally spaced-apart, parallel support members, this would add greatly to the expense of the overall assembly. Also, the use of support columns beneath the support members would not only be expensive, but also block areas beneath the members ordinarily used as walkways.

An object of this invention is to provide a fan assembly of this type in which such vibrations are dampened without excessive costs or interference with access areas.

Another object is to provide such a fan assembly having a means so dampening vibrations which is easily and quickly adjustable to compensate for changes in either the fan operating conditions or the fan construction, or both.

A further object is to provide a vibration dampening device of such construction as to permit it to be mounted on existing support means with only minor modification of its parts.

These and other objects are accomplished, in accordance with the illustrated embodiment of the invention, by a fan assembly of the type described having a spring mass assembly carried by the supporting means intermediate its ends. More particularly, the spring mass assembly preferably has a natural frequency of vibration which is approximately the same as the frequency of vibration of the supporting means at the normal speed of rotation of the fan. Thus, the spring mass applies a sinusoidal force to the supporting means which is approximately 180° out of phase with the force which causes the supporting means to vibrate, and is thus of maximum effect in dampening the vibrations.

The spring mass assembly is carried by the supporting means relatively close to the portion thereof where maximum vibration is found to occur, which is normally near the fan shaft. When, as in the illustrated embodiment of the invention, the fan motor is also carried by the supporting means to one side of the fan shaft, the spring mass assembly is supported between them.

The spring mass assembly preferably comprises at least one rod supported from the supporting means, and a weight supported on each rod remote from its support. More particularly, each weight is releasably connected to the rod so that it may be moved to different locations therealong, or removed therefrom and replaced with another weight. In this manner, the sinusoidal force applied by the spring mass assembly is adjustable in order to apply optimum vibrating force for different structural and operating conditions of the fan assembly.

In the illustrated embodiment of the invention, the spring mass assembly comprises a frame which may be easily and quickly mounted between the spaced-apart support members of the fan supporting means. More particularly, the frame is formed in a U shape comprising a pair of spaced-apart, generally parallel side members extending substantially from one support member to the other, and a bottom wall extending between the side members. A bar extends between the side members intermediate their ends, and each rod extends from each side of the bar to support a weight above the bottom wall of the frame. Thus, in the event a weight breaks off from the assembly, it is contained by the frame to prevent it from interfering with parts of the fan assembly beneath the frame.

In the drawings wherein like reference characters are used throughout to designate like parts:

Figure 1:
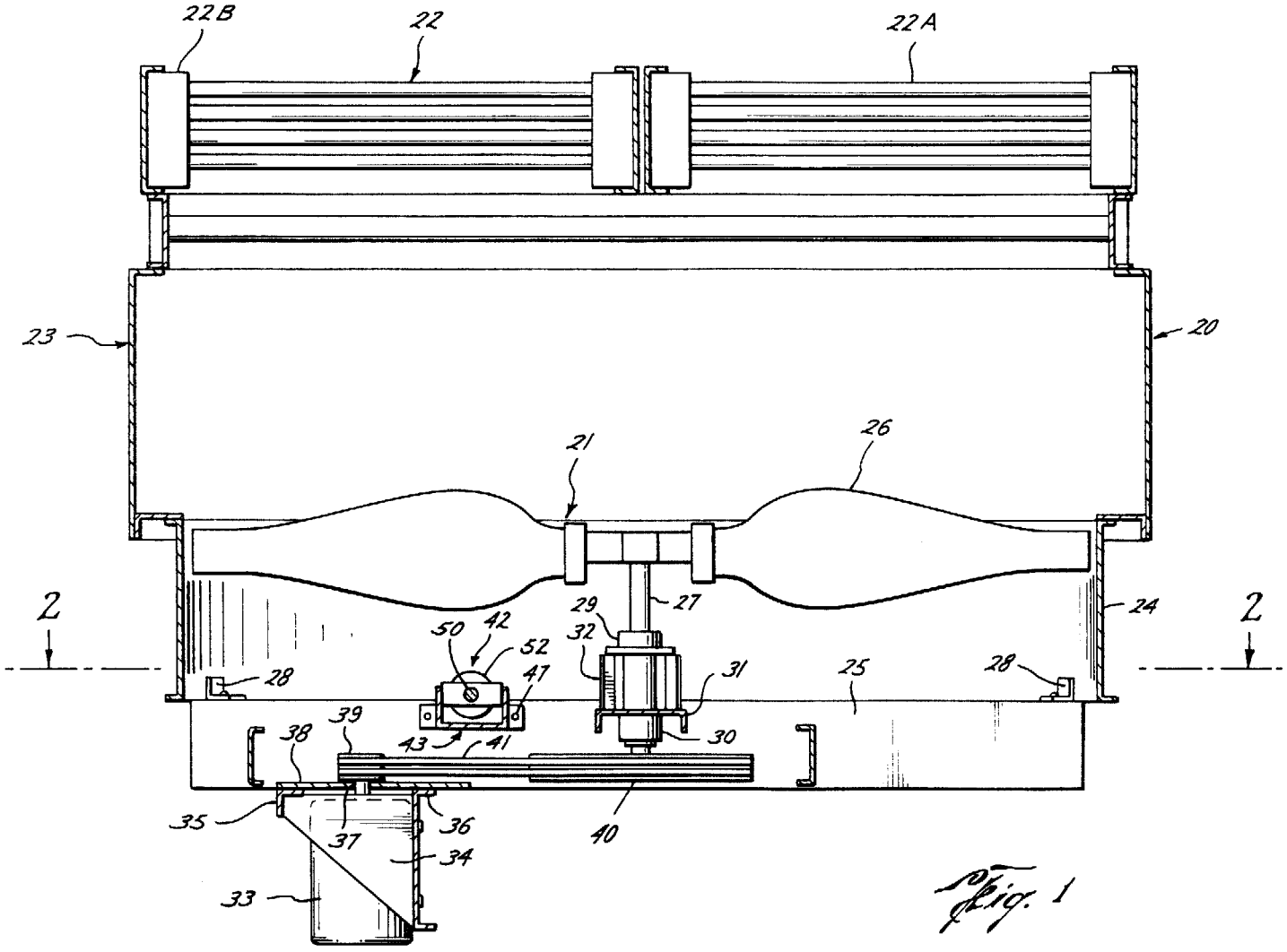
FIG. 1 is a vertical sectional view of an air cooler which has an axial fan assembly provided with a spring mass assembly in accordance with the present invention.

With reference now to the details of the above-described drawings, the air cooler shown in FIG. 1, and indicated in its entirety by reference character 20, includes a fan assembly 21 at its lower end, tube bundles 22 at its upper end and a housing 23 extending vertically therebetween. As well known in the art, the tube bundles comprise tubes 22A extending horizontally between headers 22B for circulating a medium to be cooled across the upper end of the air cooler, and the fan assembly 21 causes air to flow across the tube bundles, either upwardly or downwardly depending on its pitch. As well known in the art, fan assemblies used in such coolers are frequently 14 feet or greater in diameter. Furthermore, and as also well known in the art, the fan assembly at the lower end of the cooler is normally elevated above a walkway or other access area.

Figure 2:
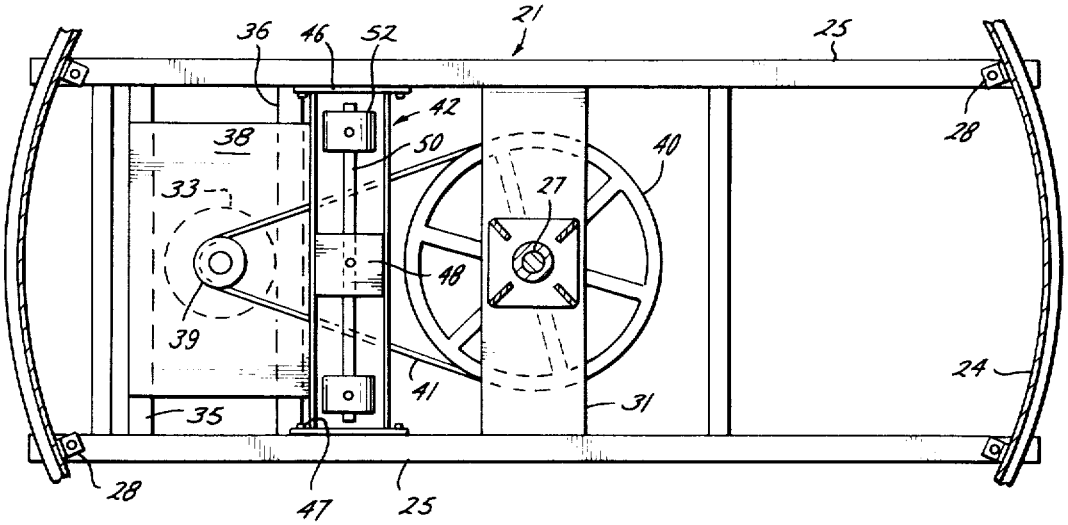
FIG. 2 is a horizontal sectional view of the fan assembly, as seen along broken line 2—2 of FIG. 1.

The fan assembly 21 is shown in each of FIGS. 1 and 2 to comprise a fan ring 24 which is usually of channel shape in cross section and supporting means for fan 26 in the form of a pair of support members 25 extending across the fan ring. More particularly, the support members extend across the fan ring in generally equally spaced-apart relation on opposite sides of the center of the ring, so as to provide a support for fan shaft 27 coaxially of the fan ring. Each such support member 25 is also conventionally of channel shape, with the channels being supported beneath the lower end of the ring 24 by brackets 28, as shown in FIG. 1.

As shown in FIGS. 1 and 2, fan shaft 27 is journalled in upper and lower bearings 29 and 30, respectively, which are in turn supported by means of a cross member 31 extending between and having its opposite ends connected to support members 25. As shown in FIG. 1, cross member 31 is conventionally an inverted channel, with the lower bearing 30 supported by the lower side of the channel, and the upper bearing 29 supported above the channel 31 by means of a spacer 32 surrounding the fan shaft 27.

The shaft is rotated by means of a motor 33 which is supported by the supporting means generally intermediate one side of the fan shaft and the fan ring. More particularly, motor 33 is supported from a bracket 34 carried by cross members 35 and 36 extending between and connected to the lower bottom webs of support members 25. More particularly, the motor is mounted with its drive shaft 37 extending vertically through a plate 38 extending between cross members 35 and 36 so as to be positioned with its axis intermediate support members 25 and to one side and on generally the same vertical level as the lower end of fan shaft 27. A sheave 39 is connected to the upper end of motor drive shaft 37, a sheave 40 is connected to the lower end of fan shaft 27, and a belt 41 extends between them for driving the shaft from the motor.

As previously described, the spring mass assembly, which is indicated in its entirety by reference character 42, is mounted on the supporting means intermediate the motor and fan shaft. More particularly, the spring mass assembly is carried with its center between the support members, and thus, as previously, described, at a location along the support means where the greatest vertical vibration has been found to occur.

Figure 3:
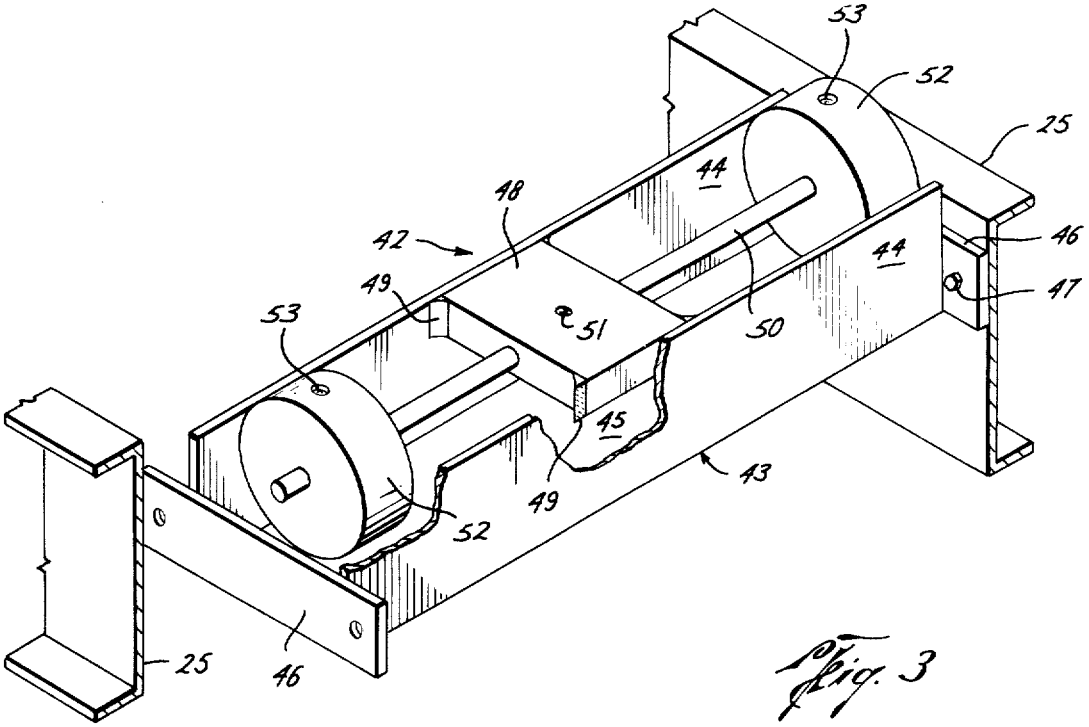
FIG. 3 is an enlarged perspective view of the spring mass assembly.

The spring mass assembly 42 is shown to comprise a frame 43 having a pair of spaced-apart side walls 44 which extend generally parallel to one another from one end to the other of the frame member, and a bottom wall 45 extending between and coextensive of the length of the side members, thereby forming a generally upright U-shape. As best shown in FIG. 3, plates 46 are connected across the open ends of the frame member in position to be secured by bolts 47 to the webs of the channel-shaped support members 25.

A bar 48 extends between the side frame members generally intermediate opposite ends of the frame and is connected thereto by means of welds 49. The bar has a hole therethrough to closely receive a round rod 50 extending generally parallel to the side frame members 44, each end of the rod 50 in effect forming a separate rod extending from one side of bar 48. Of course, rod 50 may instead be made up of separate parts, each fixedly connected to opposite sides of the bar, although the integral rod construction is preferred since it enables the rod to be adjusted longitudinally through the hole through the bar and held in fixed position by a set screw 51.

A weight 52 is mounted on each rod at a point remote from the extension of the rod from the bar 48. More particularly, each such weight is slidably received over and releasably connected to the rod by means of a set screw 53. Thus, as previously described, each weight is adjustable lengthwise of its rod, as well as removable therefrom to permit it to be replaced by a different weight.

As will be appreciated, the weights of the spring mass assembly are free to vibrate vertically whereby they will absorb part of the vertical vibration of the supporting means. Although the assembly is thus not adapted to absorb part of the horizontal vibration of the support means from one side to the other in a direction perpendicular to the extent of support members 25, these latter vibrations have been found to be of minor extent as compared with the vertical vibrations. Of course, the spring mass assembly may be so mounted as to extend the rods 50 in a direction parallel to the extension of support members 23, so that the rods, being round in cross section, are free to vibrate not only in a vertical direction, but also in a horizontal direction generally perpendicular to the extension of the support members 25, and thus allow the assembly to absorb part of the horizontal vibrations, as well as the greater vertical vibrations. Thus, in its broader aspects, this invention contemplates that the spring mass assembly may be arranged in other locations on the support means.

As previously described, in the preferred embodiment of the invention, weights 52 may be so selected and arranged along the length of rods 50 as to have a natural frequency of vibration which is approximately the same as the induced frequency of vibration of the supporting means at the normal speed of rotation of the fan. This selection and arrangement may be made in the manner illustrated in the following example.

Let it be assumed that the fan ring is 14 feet in diameter, that the fan has four equally spaced-apart blades, that the fan has a normal speed of rotation of 182 r.p.m., and that the measured pressure differential across the fan operating at this speed is 2.58 lbs./ft.$^2$. Let it further be assumed that the net free area (area within the fan ring less the area of the supporting means and other obstructions) across the fan is 145 sq. ft.

The frequency (w) of the force applied to the supporting framework is, of course, the blade pass frequency, which may be calculated in radians per second as follows:

$$w = \frac{\text{RPM of Fan} \times \text{No. of Blades}}{60 \text{ seconds}}$$

$$w = \frac{182 \times 4}{60}$$

$$w = 76 \text{ radians/sec.}$$

Let it be further assumed that the weights of the absorber are 100 pounds each suspended on a one inch diameter steel rod. Assuming still further that, despite tolerances and other margins of error, it is possible to so construct the absorber that its natural frequency ($w_1$) will match the induced frequency ($w$) within ± 4%. The spring constant ($k$) for the two rods may then be calculated as follows:

$$k = \left(\begin{array}{c}\text{Frequency of the}\\ \text{Absorber}\end{array}\right)^2 \times \left(\begin{array}{c}\text{Mass}(M)\text{ of the}\\ \text{Absorbers}\end{array}\right)$$

$$k = (0.96 \times 76)^2 \times \frac{200 \text{ lbs}}{386}$$

-continued $k = 2756$ lbs./inch

The length (L) of the each rod between its center support and the weight may then be calculated as follows:

$$L = \left(\frac{6\,EI}{K}\right)^{1/3},$$

wherein $E$ = Modulus of Elasticity of Steel, and $I$ = Moment of Inertia of the rods.

Therefore:

$$L = \frac{[6\,(30 \times 10^6)(0.049)]}{[2756]}^{1/3}$$

$$L = 14.7''$$

It's also possible to determine the effect of such an absorber in counteracting the force applied to the framework, which is a sinusoidal force due to variations in load on each blade of the fan as it passes through turbulent zones resulting from interruption of air flow by the framework.

Assume that the supporting means, including parts carried by it, weighs 800 lbs., has a spring rate ($K_1$) of 40,000 lbs./inch and a vertical displacement which is measured to be 0.008 inches, peak to peak at mid span during operation of the fan without the absorbed, and 0.004 inches with the absorber.

As long as there is no magnification of response due to the natural frequency of the supporting means being close to the natural frequency of the forces which cause it to vibrate, the maximum sinusoidal force ($F_1$) acting on the supporting means without the absorber may be calculated as follows:

$$F_1 = \text{Maximum Deflection of Framework}\left[k_1 - \text{Mass of Framework} \times (w)^2\right]$$

$$F_1 = 0.004\left[40{,}000 - \frac{800}{386} \times (76)^2\right]$$

$$F_1 = 112 \text{ lbs.}$$

The magnification ratio (M) of amplitude of the absorber relative to that of the supporting means may be calculated as follows:

$$R = \frac{1}{1 - \left(\frac{w}{w_1}\right)^2}$$

$$R = \frac{1}{1 - (0.96)^2}$$

$$R = 12.8$$

The amplitude (A) of the absorber may be calculated as follows:

$A = R \times 0.002$ $A = 12.8 \times 0.002$ $A = 0.0256$ inches.

The counteracting force (F) of the absorber may then be calculated as follows:

$F = M \times (w)^2 \times A$ $F = 200/386 \times (76)^2 \times 0.0256$ $F = 76.6$ lbs.

This force is of course more than 50 percent of the applied force.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the present invention without departing from the scope thereof, it is to be understood that all matter herein set forth or shown in the accompanying drawings is to be interpreted as illustrative and not in a limiting sense.

The invention having been described, what is claimed is:

1. An axial flow fan assembly, comprising a fan ring, supporting means extending across and connected at its opposite ends to the ring, an axial flow fan having its shaft carried by the supporting means to mount its blades for rotation within said ring, said fan shaft having means thereon to which a motor may be connected, and a spring mass assembly carried by said supporting means intermediate its opposite ends so as to absorb at least a portion of the vibration of said supporting means which results from rotation of said fan therepast.

2. A fan assembly of the character defined in claim 1, wherein said spring mass assembly comprises at least one rod supported from said supporting means, and a weight mounted on each rod remote from its support.

3. A fan assembly of the character defined in claim 2, wherein each weight is releasably connected to the rod so that it may be moved to different positions along its length or replaced by a different weight.

4. A fan assembly of the character defined in claim 1, including a fan motor connected to the blades and carried by the supporting means to one side of the fan shaft, the spring mass assembly being carried by the supporting means intermediate the motor and fan axis.

5. An axial flow fan assembly, comprising a fan ring, supporting means extending across and connected at its opposite ends to the ring, an axial flow fan having its shaft carried by the supporting means to mount its blades for rotation within said ring, said fan shaft having means thereon to which a motor may be connected, and a spring mass assembly carried by said supporting means intermediate its opposite ends and having a natural frequency of vibration which is approximately the same as the frequency of vibration of the supporting means at the normal speed of rotation of the fan.

6. A fan assembly of the character defined in claim 5, wherein said spring mass assembly comprises at least one rod supported from said supporting means, and a weight mounted on each rod remote from its support.

7. A fan assembly of the character defined in claim 6, wherein each weight is releasably connected to the rod so that it may be moved to different positions along its length or replaced by a different weight.

8. A fan assembly of the character defined in claim 5, including a fan motor connected to the blades and carried by the supporting means to one side of the fan shaft, the spring mass assembly being carried by the supporting means intermediate the motor and fan axis.

9. An axial flow fan assembly, comprising a fan ring, supporting means including a pair of generally parallel support members extending across and connected at their opposite ends to the ring, an axial flow fan having its shaft carried by the supporting means between said support members to mount its blades for rotation within said ring, said fan shaft having means thereon to which a motor may be connected, and a spring mass assembly carried by said supporting means between and intermediate the opposite ends of the support members so as to absorb at least a portion of the vibration of said supporting means which results from rotation of said fan therepast.

10. A fan assembly of the character defined in claim 9, wherein said spring mass assembly comprises a frame extending from one support member to the other, at least one rod supported by the frame, and a weight mounted on each rod remote from its support.

11. A fan assembly of the character defined in claim 10, wherein each weight is releasably connected to the rod so that it may be moved to different positions along its length or replaced by a different weight.

12. A fan assembly of the character defined in claim 9, including a fan motor connected to the blades and supported by the supporting means between said support members and to one side of the fan shaft, said spring mass assembly being carried intermediate the motor and fan shaft.

13. An axial flow fan assembly, comprising a fan ring, supporting means including a pair of generally parallel support members extending across and connected at their opposite ends to the ring, an axial flow fan having its shaft carried by the supporting means between said support members to mount its blades for rotation within said ring, said fan shaft having means thereon to which a motor may be connected, and a spring mass assembly carried by said supporting means between and intermediate the opposite ends of the support members and having a natural frequency of vibration which is approximately the same as the frequency of vibration of the supporting means at the normal speed of rotation of the fan.

14. A fan assembly of the character defined in claim 13, wherein said spring mass assembly comprises a frame extending from one support member to the other, at least one rod supported by the frame, and a weight mounted on each rod remote from its support.

15. A fan assembly of the character defined in claim 14, wherein each weight is releasably connected to the rod so that it may be moved to different positions along its length or replaced by a different weight.

16. A fan assembly of the character defined in claim 13, including a fan motor connected to the blades and supported by the supporting means between said support members and to one side of the fan shaft said spring mass assembly being carried intermediate the motor and fan shaft.

* * * * *